US005778564A

United States Patent [19]

Kettner

[11] Patent Number: 5,778,564

[45] Date of Patent: Jul. 14, 1998

[54] CHANGEABLE SHOE COVER

[76] Inventor: Mark Kettner, 247 Drake Ave., Apt. N-21, New Rochelle, N.Y. 10805

[21] Appl. No.: 816,624

[22] Filed: Mar. 13, 1997

Related U.S. Application Data

[63] Continuation-in-part of Ser. No. 555,609, Nov. 9, 1995, abandoned.

[51] Int. Cl.[6] ..... A43B 3/24

[52] U.S. Cl. ..... 36/101; 36/100

[58] Field of Search ..... 36/100, 101, 7.1 R, 36/136, 15

[56] References Cited

U.S. PATENT DOCUMENTS

| | | | |
|---|---|---|---|
| 801,899 | 10/1905 | McQuiston . | |
| 1,471,035 | 10/1923 | Keenan | 36/100 |
| 2,068,946 | 1/1937 | Ferguson | 36/101 |
| 2,235,490 | 11/1941 | Saska | 36/101 |
| 2,261,125 | 11/1941 | McFeely | 36/2.5 |
| 3,119,191 | 1/1964 | Vitzthum | 36/100 |
| 3,221,421 | 12/1965 | Liebmann et al. | 36/2.5 |
| 3,972,136 | 8/1976 | Epstein | 36/101 |
| 3,994,080 | 11/1976 | Flanagan, Jr. et al. | 36/100 |
| 4,103,440 | 8/1978 | Lawrence | 36/101 |
| 4,333,248 | 6/1982 | Samuels | 36/101 |
| 4,713,895 | 12/1987 | Vallieres | 36/7.1 R |
| 4,745,693 | 5/1988 | Brown | 36/101 |
| 4,850,122 | 7/1989 | Schwab, Jr. | 36/72 R |
| 4,958,447 | 9/1990 | Dupree | 36/100 |
| 5,065,531 | 11/1991 | Prestidge | 36/100 |
| 5,144,759 | 9/1992 | Mascotte | 36/7.1 R |
| 5,165,182 | 11/1992 | Michael | 36/7.1 R |

FOREIGN PATENT DOCUMENTS

| | | | |
|---|---|---|---|
| 1685 | 3/1861 | Netherlands | 36/100 |
| 78485 | 12/1931 | United Kingdom | 36/100 |

*Primary Examiner*—M. D. Patterson
*Attorney, Agent, or Firm*—Richard A. Joel, Esq.

[57] ABSTRACT

A show having a removable cover for the upper is disclosed. The cover is removably secured to the unfinished shoe upper by hook and loop fastener strips on the lower parts of the cover and shoe upper adjacent to the line where the upper joins the sole of the shoe. The lower edges of the cover are concealed by a vertical strip about the periphery of the sole.

2 Claims, 7 Drawing Sheets

CHANGEABLE SHOE COVER

CROSS-REFERENCE TO RELATED APPLICATION

This application is a continuation-in-part-application of my co-pending application Ser. No. 08/555,609 filed Nov. 9, 1995, abandoned, entitled CHANGEABLE SHOE COVER.

BACKGROUND OF THE INVENTION

1. Field of the Invention

This invention relates to footwear, more particularly to sport and athletic shoes which have become universally popular, not only for athletes, but for walking and simply for style and/or fashion considerations.

The athletic shoe industry has burgeoned over the past years and comprises a substantial proportion of all footwear sold in the United States and elsewhere. The shoes which also provide basic utilitarian considerations have developed in upper end sales due to the significance of brand name, various decorative materials and fabrics used, color and ornamentation and celebrity endorsements. Such ornamental design features and the endorsements by well known celebrity sport figures often exceed utilitarian considerations in the popularity of specific shoes. Due to such factors, the shoes often sell for significantly over one hundred dollars a pair.

When the upper portions of the shoes get soiled and/or stained there is no satisfactory way of cleaning them thoroughly within a reasonable amount of time. Such shoes are often washed and dried in a home dryer or commercially but the fashion qualities and functional qualities of the shoe are diminished and the useful life of the item is substantially shortened.

As a practical matter, in many cases one wears these very expensive athletic shoes for a short period of time, they get soiled and dirty, and get downgraded from everyday fashion use, and relegated to the status of a work shoe, or worse yet are discarded completely. Because of the high cost of such shoes owning a number of pairs for rotational purposes, for most people, is financially impractical, aside from the bulkiness of storing multiple pairs of such shoes which are often many times more bulky then regular shoes.

Various attempts have been made to deal with this problem by the prior art and none have been completely satisfactory. Some approaches have included providing changeable uppers and sole structures so that the upper and the sole can be independently exchanged and matched.

Such approaches usually involve very expensive and complex constructions such as disclosed in U.S. Pat. No. 5,065,531 Prestridge which from the point of view of strength is satisfactory, however, the structure therein is very expensive and complex.

In U.S. Pat. No. 4,745,693 Brown a slide fastener or zipper was utilized to attach the upper and sole of the footwear together, however, the structural integrity of said combination left much to be desired due to the rough and tumble uses to which athletic shoes are subjected. In addition, the zipper was easily damaged resulting in a complete scrapping of the shoe or very expensive repairs required with very few craftsmen capable of undertaking such repair. Furthermore, zipper construction was aesthetically unattractive.

Also, in the past, the prior art has attempted to put simple covers on shoes, however, few have been directed towards the construction of athletic shoes and usually involve complex structures.

In accordance with the present invention, an easily changeable cover for the upper portion of athletic shoes is provided which includes a tongue and lace eyelets all of which are easily fastened to underlying structure by means of combination of nylon hook and loop fasteners of the Velcro™ type, strategically placed which enables a quick change and a utilization of covers which are completely unobtrusive and very attractive.

2. Prior Art

U.S. Pat. No. 801,899 McQuiston shows a ladies dress shoe which has a cover changeable for fashion purposes which this case is an overshoe type of cover with an opening for the high heel protruding through.

A snap-on removable cover for the forward portion of a man's shoe is shown in U.S. Pat. No. 2,068,946 Ferguson for fashion purposes and it is also contemplated to utilize it to cover up the soiled surface of a shoe.

In U.S. Pat. No. 2,261,125 McFeely the sole and upper are separable so the uppers may be changed dispensing with the need to buy multiple pairs of shoes in order to obtain a style change. This enables the upper to be changed to provide footwear in conformity with the style of clothing that the user is wearing.

In U.S. Pat. No. 3,221,421 Liebmann et al there is shown a decorative cover for women's shoes. In this case, the cover is stretched over the shoe. Means are provided for folding over the margins along the top edge of the foot opening to provide a finished appearance.

U.S. Pat. No. 3,972,136 Epstein discloses a man's footwear construction with removable replaceable vamps and/or plug sections that are joined to each other with slide fasteners and intervening stretch material.

U.S. Pat. No. 4,103,440 Lawrence discloses a shoe construction in which the entire upper is detachable from the sole and is joined thereto by a zipper connection.

U.S. Pat. No. 4,850,122 Schwab, Jr. discloses a shoe cover comprising a patch with two lobes one for covering the outside of the shoe, and one for covering the inside, to provide a change in shoe appearance. It is contemplated that a stretch fabric will be employed.

In U.S. Pat. No. 5,065,531 Prestridge there is disclosed a changeable upper and tongue insert for the upper. Matching male and female tracks are provided for joining the upper and sole portions.

SUMMARY OF THE INVENTION

In accordance with the present invention athletic shoes are constructed in the usual manner with the only difference being that the uppers are constructed without a built in tongue and without necessarily having a finished outer cover surface.

The margin where the upper is joined to the sole is provided about the periphery with a hook or loop fastening strip and in the vicinity of the heel a vertical strip is provided. In addition, about the margin of the lace portion or vamp additional strips are provided whereby a portable cover comprising an upper having matching Velcro™ strips on it's margin and adjacent the lace portion is provided. It also has a tongue and corresponding strip to match the vertical strip of the heel of the shoe structure and overlying matched strips for the left or right margin to overlap the right or left margin at the heel.

The present invention is illustrated in the accompanying drawings which form a part of this specification and illustrate a more specific and preferred embodiment of the invention, however, it is to be understood that this is only representative of various embodiments which may be utilized within the broad scope of the invention.

BRIEF DESCRIPTION OF THE DRAWING

In the accompanying drawing which forms a part of this specification.

ILLUSTRATIVE SPECIFIC EMBODIMENT

Figure 1:
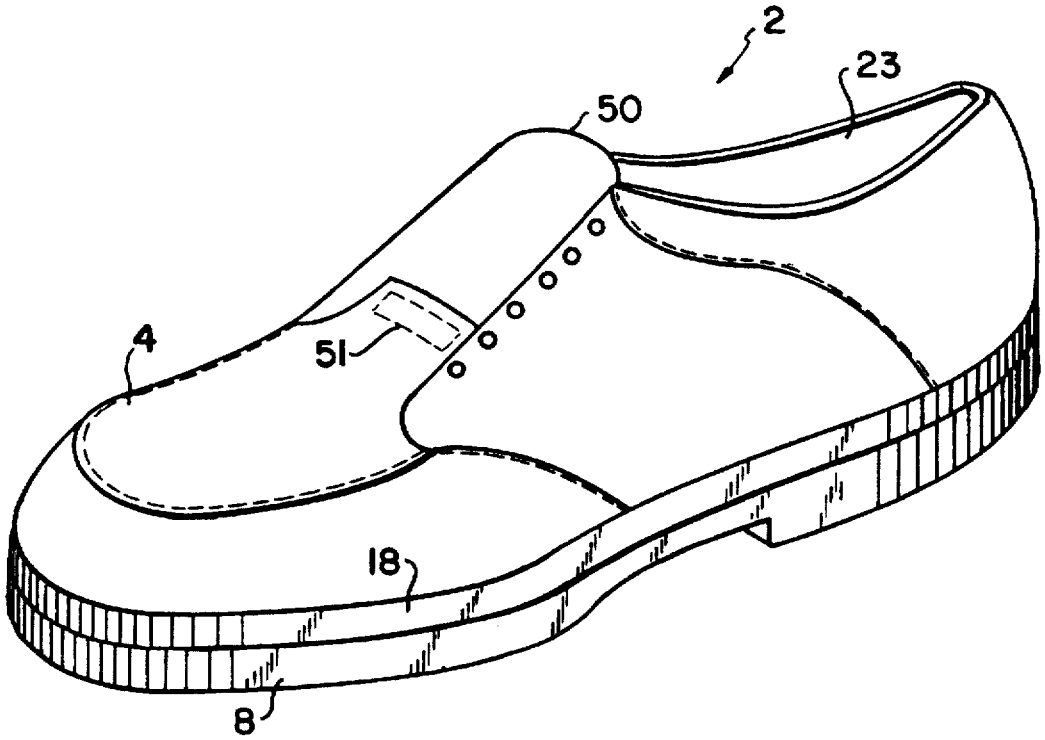
FIG. 1 is a perspective view of the athletic shoe of the present invention with a removable cover in place thereon.
Figure 2:
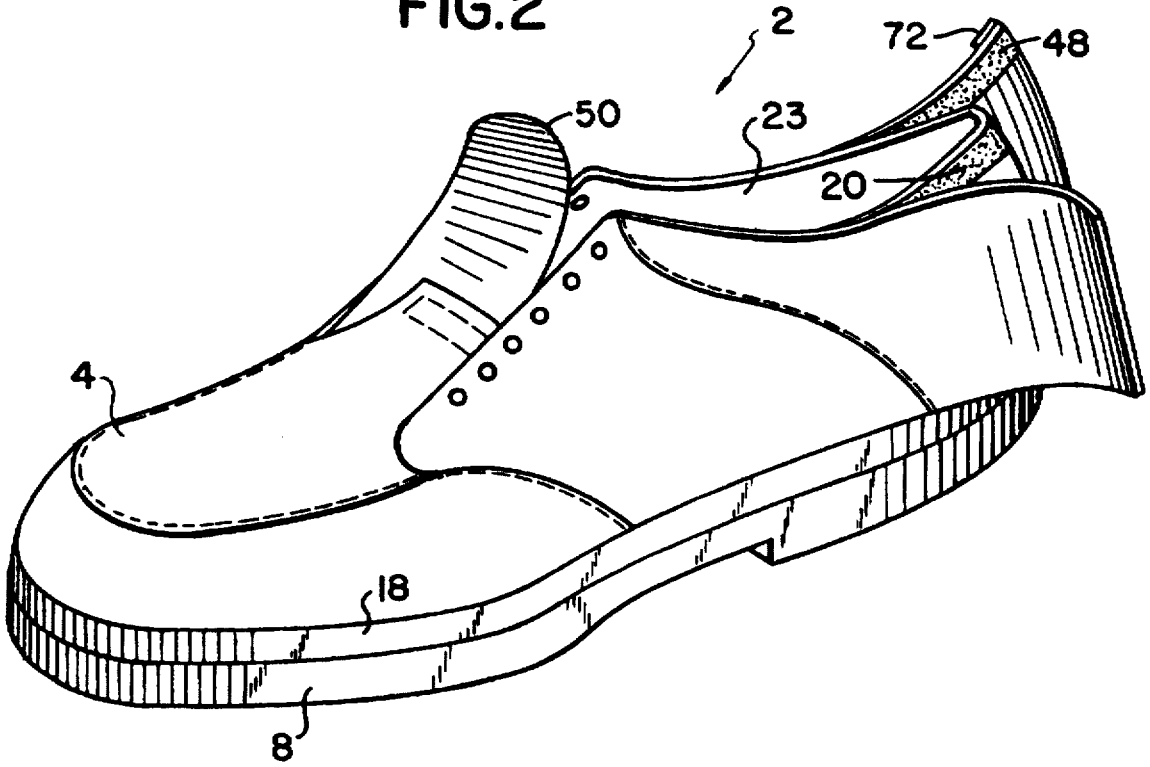
FIG. 2 is a perspective view of the shoe of the present invention with the cover being attached thereto.

An athletic shoe incorporating the concept of the present invention is shown in the accompanying drawings. The shoe 2 is shown with the cover 4 of the present invention in place on the upper portion 6 of the shoe. The cover 4 along its bottom periphery 9 runs adjacent to the cushioned sole 8.

Figure 5:
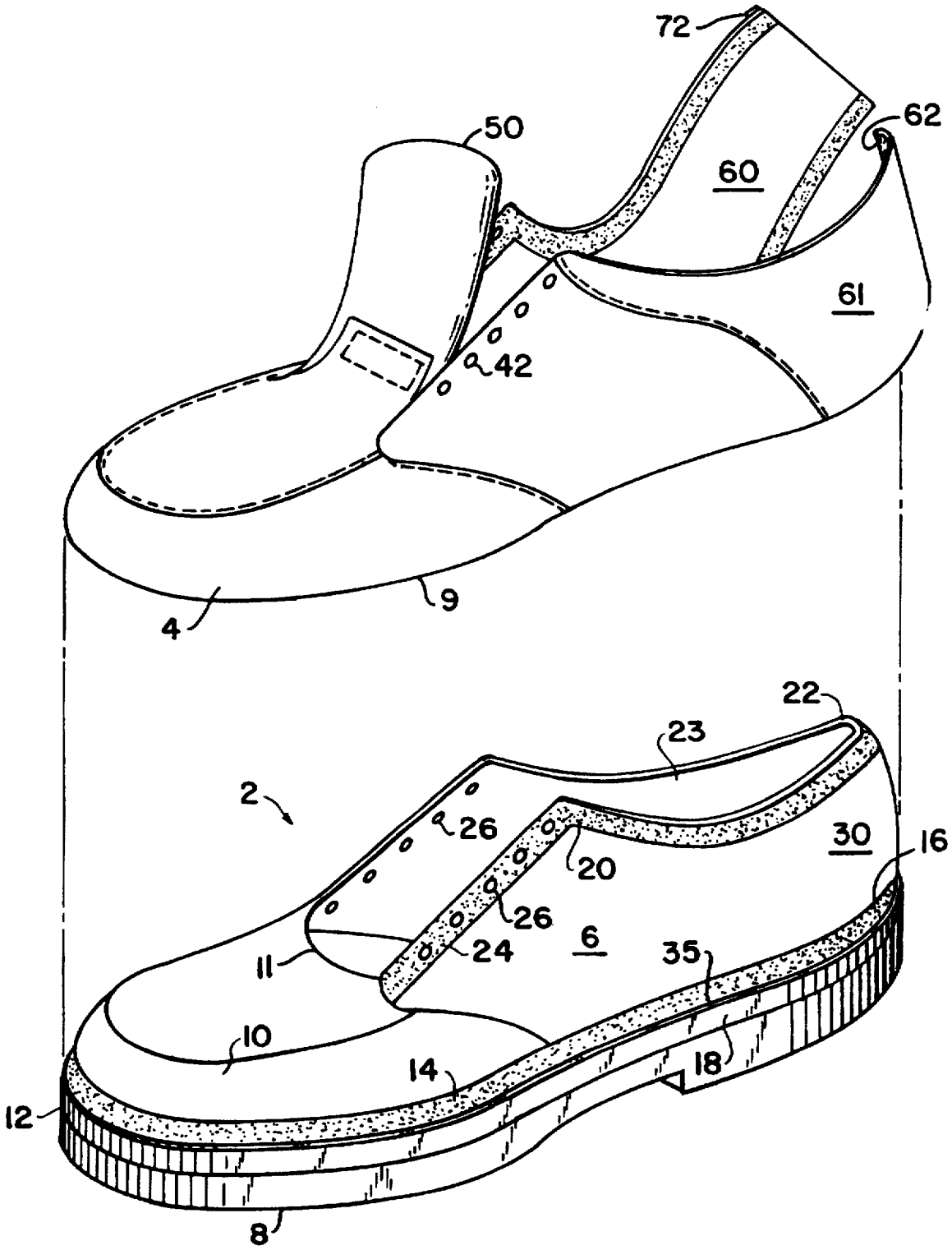
FIG. 5 is a perspective of the shoe and cover disassembled;(with the cover being placed thereon;)

The shoe 2 without the cover 4 is shown in FIG. 5 and includes an underlying rough finish upper 10, finish strips 18, a fastening strip 14 secured generally by adhesive about the lower periphery adjacent to a point where the upper margins of the sole 8 are located. A similar fastening strip 20 follows the upper margin 22 of the opening 23 for the foot and down around the lace opening 24 and eyelets 26 for laces.

The thickness 35 of strip 18 if fixed so that its outer surface is flush with the outer finish of the cover 4 when in place on the shoe 2 to provide a neat finished appearance.

Figure 10:
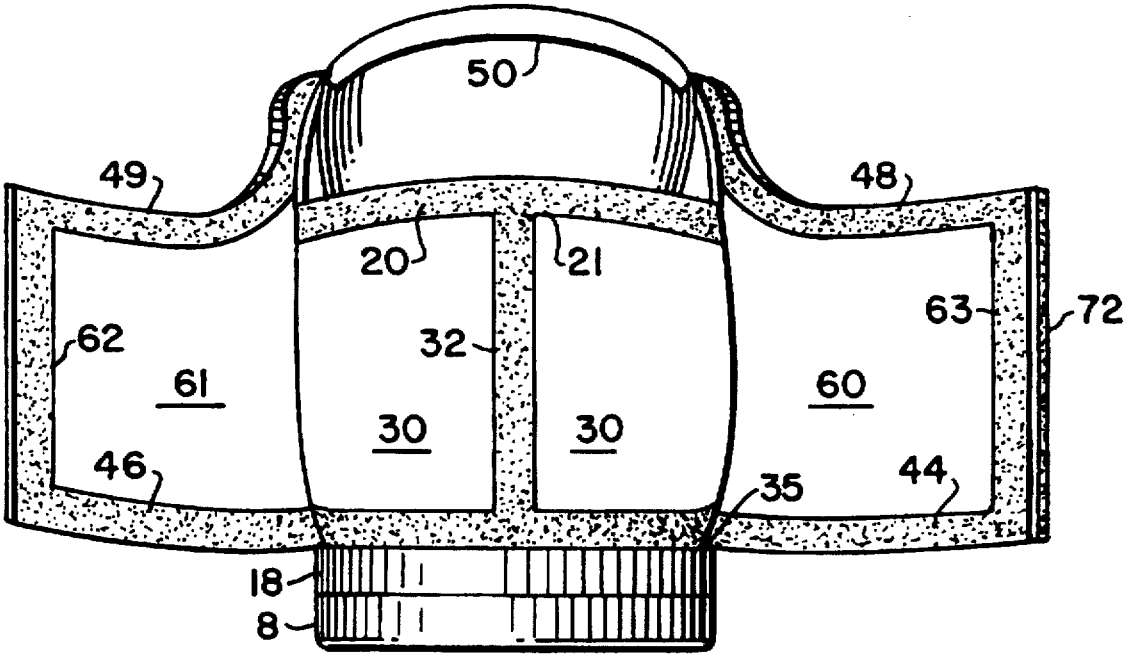
FIG. 10 is a rear elevational view of the heel of the shoe showing an alternative embodiment of the cover and securing strips prior to closing? the cover over the heel.
Figure 11:
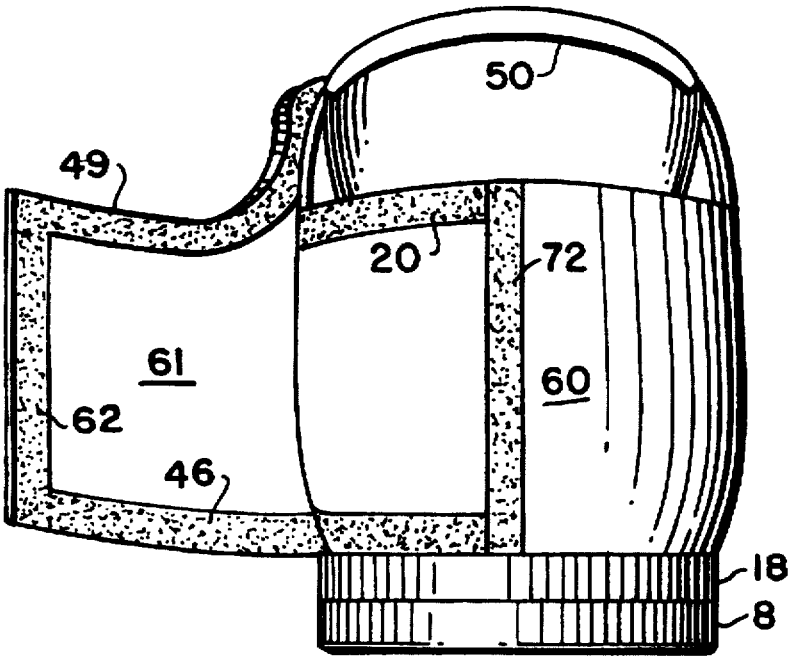
FIG. 11 is a similar view with the right rear of the cover on the heel with the left rear heel of the cover ready to be closed in place.

In the heel portion 30 a vertical strip 32 of connecting fastening material runs between the upper 22 and lower 16 margins in the embodiment of FIGS. 10 and 11.

Figure 3:
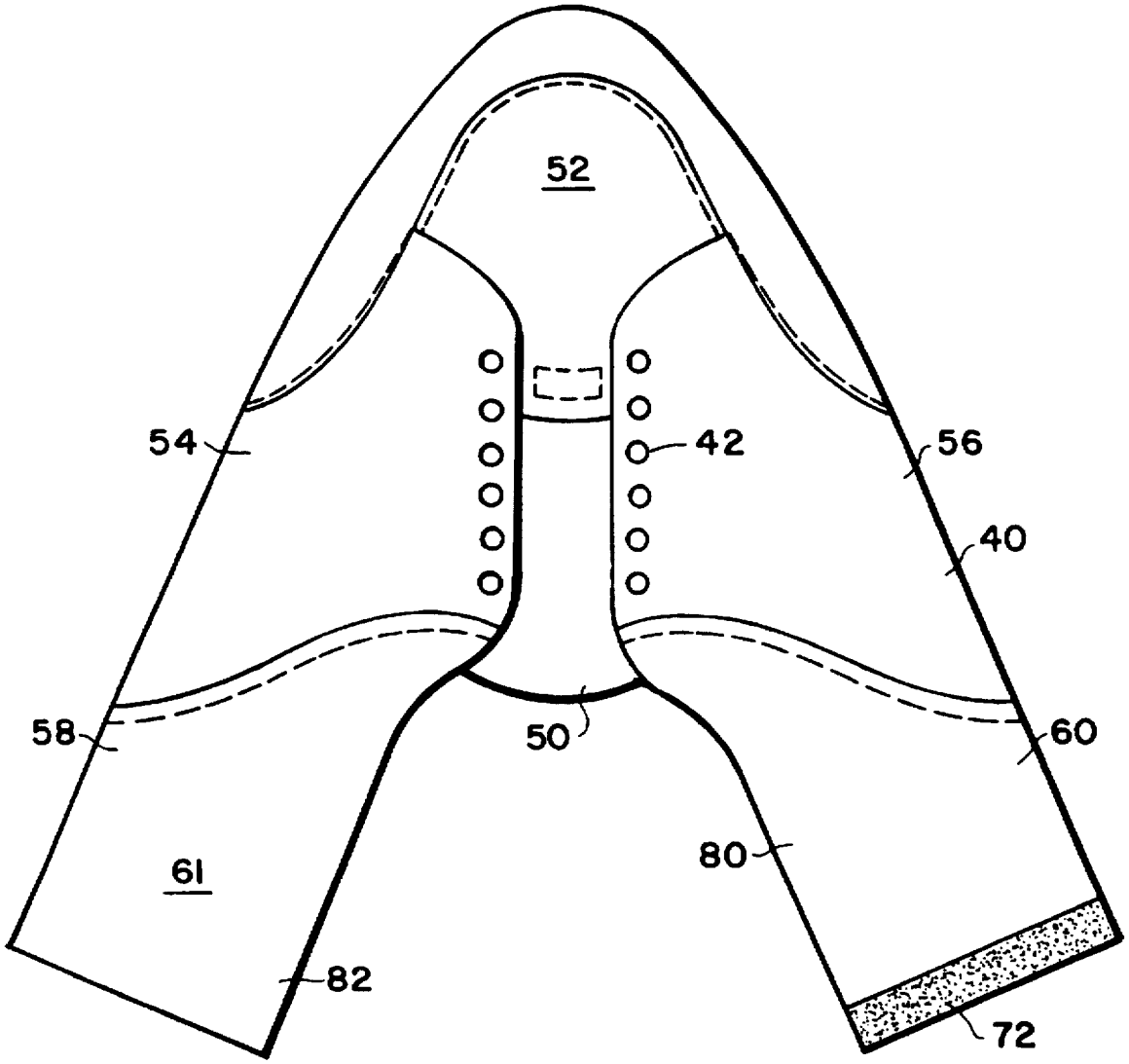
FIG. 3 is a top view of the cover.
Figure 4:
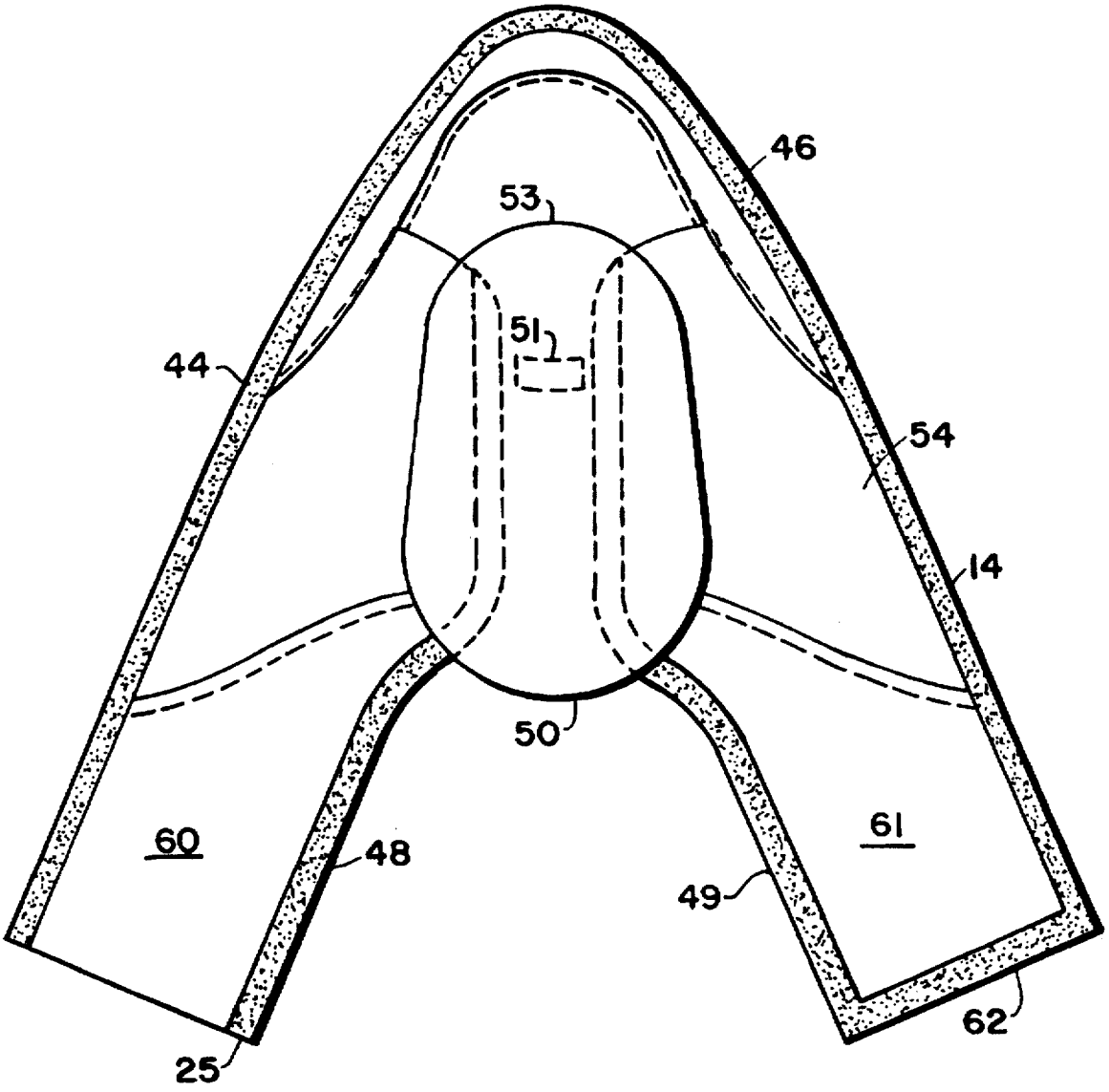
FIG. 4 is a bottom view thereof.

The cover 4 according to the present invention is shown in FIGS. 3 & 4 includes a finished outer surface material 40 in the form shown with eyelet openings 42 corresponding to those eyelets 26 in the underlying shoe 2, and a tongue portion 50. The tongue 50 is stitched to the cover 4 at 51 and the forward portion 53 of the tongue 50 is tucked under the forward portion 11 of the cover. The outer or finished surface 56 is shown in FIG. 3 and the reverse side 54 thereof shown in FIG. 4.

About the periphery 46 where the cover 4 meets the sole 8 of the shoe 2 are fastening are a fastening strips 48 and 49 along the upper margin 22.

As shown in FIG. 4 a vertical strip 62 adjacent rear portion which covers the heel 30 on the outside so that the cover 4 may overlap vertical strip 32 portion of the shoe 2 and the strip 62 matches the strip 72 on the outerside of the cover 4.

In FIG. 3 the outer surface of the cover 2 is shown and comprises the toe portion 52 and main left body 54 and a right body 56 with the left side 82 and the right side 80 and the rear towards heel portions 60 and 61.

Figure 6:
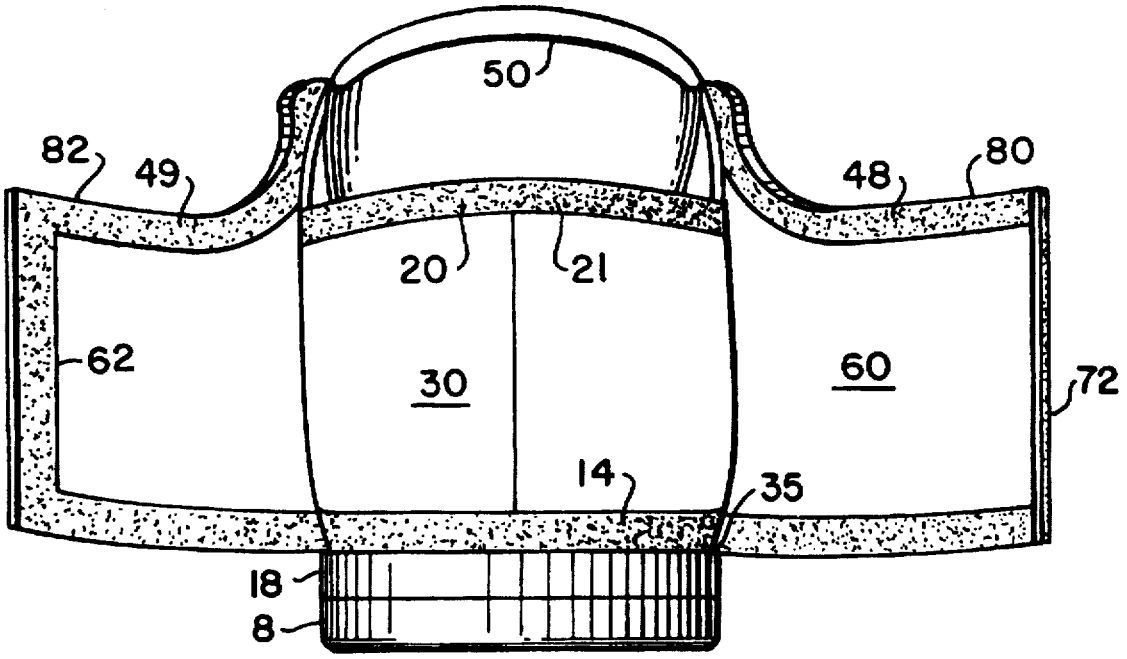
FIG. 6 is a rear elevational view of the heel of the shoe with cover prior to closure over the heel.
Figure 7:
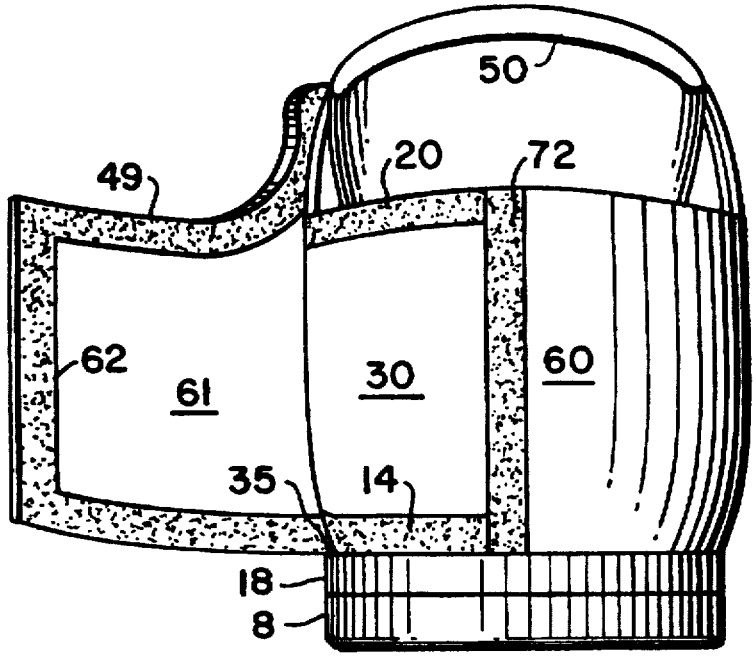
FIG. 7 is a similar view with the right side of the cover in place on the heel.
Figure 8:
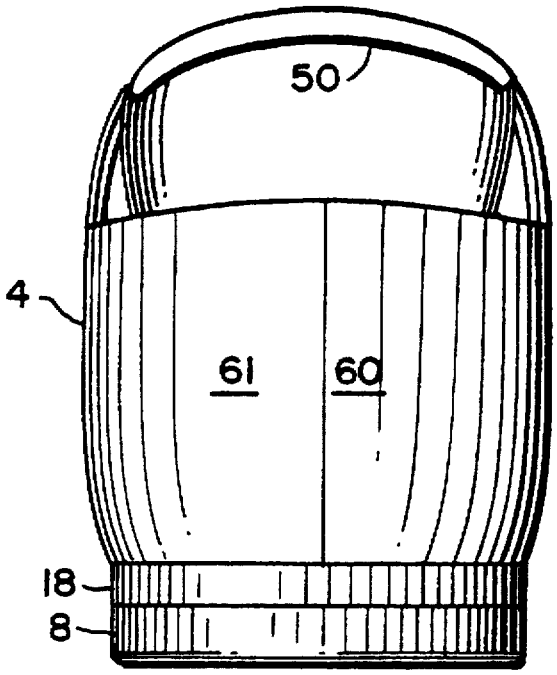
FIG. 8 is a similar view with the left side of the cover in place on the heel overlapping the end of the right side of the cover.
Figure 9:
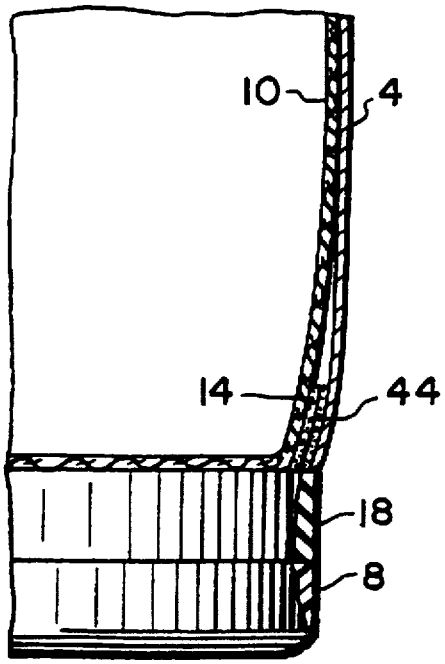
FIG. 9 is a partial sectional view of the rear right side of the covered shoe showing the base cover, shoe base connecting and finish strips in place.

The inner side as shown in FIG. 4 includes lower marginal periphery to which is stitched connecting strips 44 and 46. The rear portion of the heel 61 has vertical strip 62 stitched as shown, which matches the other of which overlaps and is secured to 72 as best shown in FIGS. 6 and 7. The upper edges are provided with a connecting strips 48 and 49 which are positioned over the eyelet opening 42. The tongue 50 is stitched forward underneath portion of the eyelet openings as shown in FIGS. 3 and 4.

On the outer surface numerous appropriate logos can be printed or fastened. They are adhesively secured or stitched to the cover 4. The outer surface may comprise a variety of materials and colors. The undersurface is usually a neutral color.

The cover 4 is applied to the shoe upper body simply by pressing the connecting hook strips 44, 46, 48, 49, and 62 against corresponding hook/loop strips 14 and 20 and optionally 32 on the shoe 2, commencing preferably at the toe and working rearwardly along the main body portion to the sides with the end 82 applied to the heel first with the contact strip 72 matching up. The strips of the left margin overlie the right margin as indicated in FIG. 5.

A number of covers may be utilized alternately for a variety of appearances and to maintain a clean appearance of the shoes.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A shoe having a changeable cover for the upper portions thereof, said shoe comprising an upper portion secured to a sole and having an opening at the upper regions thereof for insertion of a foot, the lower periphery of said upper portion secured to said sole of said shoe, upper and lower edges of said upper, each of said edges having a continuous strip of loop and hook nylon fastener secured to the lower margin of said upper of said shoe and to said upper margin of said upper shoe, said lower one adjacent to and abutting said sole, a cover for said shoe including a tongue and having a decorative outer surface and patterned to match the corresponding upper section of said shoe, lace eyelet portions corresponding with the outer portions of said shoe and continuous corresponding loop and hook nylon fasteners along the lower interior perimeter of said cover and the upper interior perimeter of said cover, said fasteners adapted to be matched to said corresponding fasteners on the shoe itself, whereby said cover may be removably attached to said shoe; and said fasteners being concealed from view when said cover is attached to said shoe.

2. A shoe as claimed in claim 1 wherein the lower margin of said shoe has a vertical strip about the periphery of said sole to conceal the lower edge of said changeable cover.

* * * * *